United States Patent [19]

Suzuki

[11] Patent Number: 4,732,130

[45] Date of Patent: Mar. 22, 1988

[54] APPARATUS FOR CONTROLLING AIR-FUEL RATIO FOR INTERNAL COMBUSTION ENGINE

[75] Inventor: Michio Suzuki, Hekinan, Japan

[73] Assignee: Toyota Jidosha Kabushiki Kaisha, Aichi, Japan

[21] Appl. No.: 931,621

[22] Filed: Nov. 17, 1986

[30] Foreign Application Priority Data

Dec. 19, 1985 [JP] Japan ..... 60-286388

[51] Int. Cl.[4] ..... F02M 51/00

[52] U.S. Cl. ..... 123/480; 74/860; 364/431.05

[58] Field of Search ..... 123/478, 480, 489; 74/859, 860; 364/431.05

[56] References Cited

U.S. PATENT DOCUMENTS

| | | | |
|---|---|---|---|
| 4,165,722 | 8/1979 | Aoyama | 74/860 X |
| 4,245,604 | 1/1981 | Lahiff | 74/860 X |
| 4,346,625 | 8/1982 | Latsch et al. | 74/860 X |
| 4,484,555 | 11/1984 | Miura | 74/860 X |
| 4,535,736 | 8/1985 | Taura et al. | 364/431.05 X |
| 4,596,164 | 6/1986 | Hasegawa et al. | 74/860 |

FOREIGN PATENT DOCUMENTS 0211543 12/1983 Japan .

*Primary Examiner*—Willis R. Wolfe, Jr.
*Attorney, Agent, or Firm*—Kenyon & Kenyon

[57] ABSTRACT

An apparatus for controlling an air-fuel ratio for an internal combustion engine in which the air-fuel ratio is controlled to the leaner side of a stoichiometric air-fuel ratio in a normal operating condition. As the speed reduction ratio decreases, the air-fuel ratio is controlled so as to become increasingly leaner than the stoichiometric air-fuel ratio. Thus, when the speed reduction ratio is relatively large, the air-fuel ratio is controlled so as to be richer than a critical air-fuel ratio concerning misfire, thereby preventing occurrence of a surge in the engine output which would otherwise be caused by a change in combustion state. When the speed reduction ratio is relatively small, the air-fuel ratio is made to approach said critical air-fuel ratio in order to decrease the rate of fuel consumption.

12 Claims, 7 Drawing Figures

APPARATUS FOR CONTROLLING AIR-FUEL RATIO FOR INTERNAL COMBUSTION ENGINE

BACKGROUND OF THE INVENTION

1. Field of the Invention

The present invention relates to an apparatus for controlling an air-fuel ratio for an internal combustion engine. More particularly, the present invention pertains to an apparatus for controlling an air-fuel ratio for an internal combustion engine such that the air-fuel ratio coincides with a stoichiometric air-fuel ratio, and when the engine is under a predetermined operating condition, the air-fuel ratio is maintained at the leaner side of the stoichiometric air-fuel ratio.

2. Description of the Related Art

To simultaneously reduce the amounts of HC, CO and $NO_X$ in exhaust gas, one type of air-fuel ratio feedback control has heretofore been practiced in which a basic fuel injection quantity is determined on the basis of an engine load (e.g., an intake-air quantity per revolution of an engine or an intake-pipe pressure) and a rotational speed of the engine, and this basic fuel injection quantity is corrected in accordance with the output of an $O_2$ sensor which detects the residual oxygen concentration in the exhaust gas. In this air-fuel ratio feedback control, a partial-lean control is effected for the purpose of decreasing the rate of fuel consumption and of reducing the amounts of HC and CO in the exhaust gas. More specifically, when the engine operation is under such a condition that the engine load and the rotational speed of the engine are within a predetermined region where the amounts of noxious components in the exhaust gas are relatively small, the feedback control is suspended and switched to a partial-lean control in which the air-fuel ratio is maintained at the leaner side of the stoichiometric level through an open loop control. In the conventional partial-lean control, since misfire occurs very often when the air-fuel ratio is overlean, the leanest value for the air-fuel ratio is set in the vicinity of a misfire region in which misfire may occur and which is determined by both the engine load Q/N and the engine rotational speed N as shown in the specification of Japanese Patent Laid-Open No. 211543/1983. Since the critical air-fuel ratio concerning the misfire region (hereinafter referred to as "critical misfire air-fuel ratio") becomes increasingly leaner than the stoichiometric air-fuel ratio as the engine load and the engine speed increase, the air-fuel ratio can be controlled so as to be increasingly leaner as the engine load and the engine speed increase.

The vibration of a vehicle caused by surges of the engine output overlaps a vibration frequency band to which man is most sensitive when the rotational speed as an output of a transmission is small relative to the rotational speed of the engine (i.e., when the speed reduction ratio is large). Accordingly, when the leanest value in the partial-lean control is set in the vicinity of the misfire region as in the conventional practice, unpleasant surges may be generated due to changes in combustion state particularly when the vehicle is running in the 1st speed gear position, causing driveability to be deteriorated. To overcome this problem, it may be taken into consideration to set the leanest value in the partial-lean control so as to be richer than the critical misfire air-fuel ratio on the basis of the 1st speed gear position. In such arrangement, however, the air-fuel ratio is controlled such as to be richer than the critical misfire air-fuel ratio even when the transmission is set in an intermediate speed gear position or in the top speed gear position where the driveability is not deteriorated by the occurrence of surges because the surge frequency is sufficiently high, resulting disadvantageously in an increase in the rate of fuel consumption.

SUMMARY OF THE INVENTION

In view of the above circumstances, it is a primary object of the present invention to provide an apparatus for controlling an air-fuel ratio for an internal combustion engine which is so designed that the rate of fuel consumption is minimized without deteriorating driveability by taking the speed reduction ratio into consideration.

To this end, the present invention provides an apparatus for controlling an air-fuel ratio for an internal combustion engine, comprising: calculating means for calculating a basic fuel injection quantity on the basis of an engine load and a rotational speed of the engine; operating condition detecting means for detecting an operating condition of the engine; speed reduction ratio detecting means for detecting a speed reduction ratio set in a transmission; and control means which controls, when a predetermined operating condition is detected, the air-fuel ratio so as to be leaner than a stoichiometric air-fuel ratio on the basis of the basic fuel injection quantity in such a manner that the degree by which the air-fuel ratio is made leaner than the stoichiometric air-fuel ratio is greater when the speed reduction ratio is relatively small than that in the case where the speed reduction ratio is relatively large. The control means may include fuel injection quantity calculating means for calculating a fuel injection quantity on the basis of a basic fuel injection quantity, an engine operating condition and a speed reduction ratio, and fuel injection means for injecting fuel on the basis of the output of the fuel injection quantity calculating means.

By virtue of the above-described arrangement, a basic fuel injection quantity is calculated by the calculating means on the basis of an engine load and a rotational speed of the engine, and when a predetermined operating condition, e.g., a normal operating condition, is detected by the operating condition detecting means, the air-fuel ratio is controlled so as to be at the leaner side of a stoichiometric air-fuel ratio by the control means on the basis of the basic fuel injection quantity. In this predetermined operating condition, the control means controls the air-fuel ratio on the basis of the speed reduction ratio detected by the speed reduction ratio detecting means in such a manner that the degree by which the air-fuel ratio is made leaner than the stoichiometric air-fuel ratio is greater when the speed reduction ratio is relatively small than that in the case where the speed reduction ratio is relatively large. In consequence, when the speed reduction ratio is relatively large, the air-fuel ratio is controlled so as to be richer than the critical misfire air-fuel ratio, thereby preventing occurrence of surges in the engine output which would otherwise be caused by changes in combustion state, whereas, when the speed reduction ratio is relatively small, the air-fuel ratio is made to approach the critical misfire air-fuel ratio, thereby allowing the rate of fuel consumption to be minimized. When the speed reduction ratio is relatively small, surges of the engine output may be generated since the air-fuel ratio is controlled so as to be in the vicinity of the misfire region. However, since the frequency of the surges in this case is sufficiently high, the driver feels no unpleasantness and there is therefore no adverse effect on the driveability.

As has been described above, according to the present invention, the air-fuel ratio is controlled so that the degree by which the air-fuel ratio is made richer than a stoichiometric air-fuel ratio is greater when the speed reduction ratio is relatively large than that in the case where the speed reduction ratio is relatively small. It is therefore possible to minimize the rate of fuel consumption without any fear of driveability being degraded by possible surges of the engine output. In addition, when the speed reduction ratio is relatively small, the air-fuel ratio is controlled so that the degree by which the air-fuel ratio is made leaner than the stoichiometric air-fuel ratio is greater than that in the case where the speed reduction ratio is relatively large. Accordingly, it is advantageously possible to reduce the amount of entire $NO_X$ in the exhaust gas over all the operating conditions of the engine.

DESCRIPTION OF THE PREFERRED EMBODIMENTS

Preferred embodiments of the present invention will be described hereinunder in detail with reference to the accompanying drawings.

Figure 1:
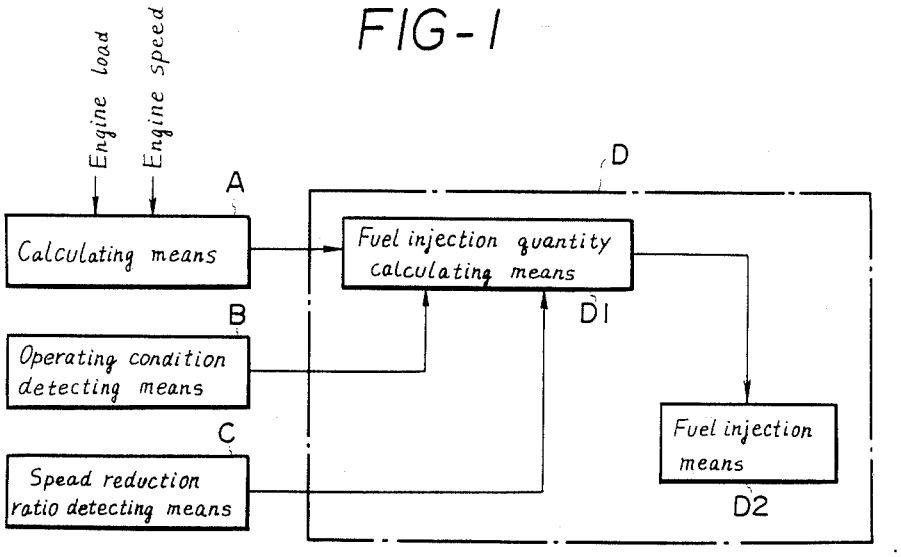
FIG. 1 is a block diagram showing the general arrangement of one embodiment of the present invention.
Figure 2:
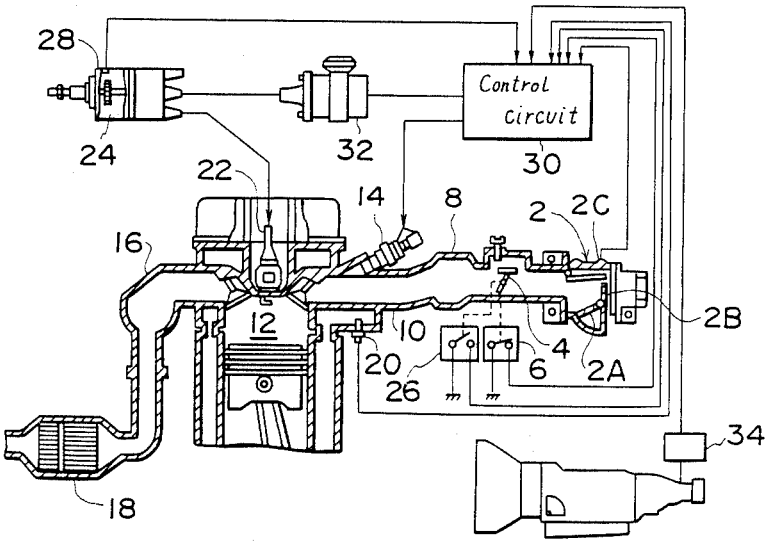
FIG. 2 schematically shows an engine to which the present invention may be applied.

FIG. 2 schematically shows an internal combustion engine (hereinafter referred to as an "engine") equipped with a manual transmission to which one embodiment of the air-fuel ratio control apparatus according to the present invention is applied.

An air flowmeter 2 is disposed on the downstream side of an air cleaner (not shown). The air flowmeter 2 consists of a compensation plate 2A pivotally provided within a damping chamber, a measuring plate 2B adapted to pivot in response to the movement of the compensation plate 2A, and a potentiometer 2C adapted to convert the pivotal movement of the measuring plate 2B into a voltage. A throttle valve 4 is disposed on the downstream side of the air flowmeter 2. An idle switch 6 is secured to the shaft of the throttle valve 4. The switch 6 is actuated in response to the movement of the throttle valve 4 in such a manner that, when the valve 4 is in the full-closing position (during idling), the switch 6 is turned on, whereas, when the valve 4 is in an open position, the switch 6 is turned off. In addition, a throttle full-open switch 26 is secured to the shaft of the throttle valve 4 in such a manner that the switch 26 is turned on when the valve 4 is in the full-open position (during full-load operation). A surge tank 8 is disposed on the downstream side of the throttle valve 4, and communicated with a combustion chamber 12 of the engine through an intake manifold 10. A fuel injection valve 14 is provided on the intake manifold 10 for each cylinder of the engine. The combustion chamber 12 of the engine is communicated through an exhaust manifold 16 with a catalyst device 18 which is filled with a ternary catalyst. A cooling water temperature sensor 20 is mounted on the engine block, the sensor 20 being adapted to detect the temperature of water for cooling the engine and output a cooling water temperature signal. The distal end of an ignition plug 22 extends into the combustion chamber of the engine. A distributor 24 is connected to the ignition plug 22. The distributor 24 is provided with an engine speed sensor 28 which is constituted by a pickup rigidly secured to the distributor housing and a signal rotor rigidly secured to the shaft of the distributor 24.

The engine speed sensor 28 outputs an engine speed signal which is raised to a high level, e.g., every crank angle of 30° to a control circuit 30 which is constituted by a microcomputer or other similar means. The distributor 24 is connected to an ignitor 32. The reference numeral 34 in FIG. 2 denotes a vehicle speed sensor which is constituted by a magnet rigidly secured to a speedometer cable rotated by the output shaft of a transmission, and a magnetic sensitive element.

Figure 3:
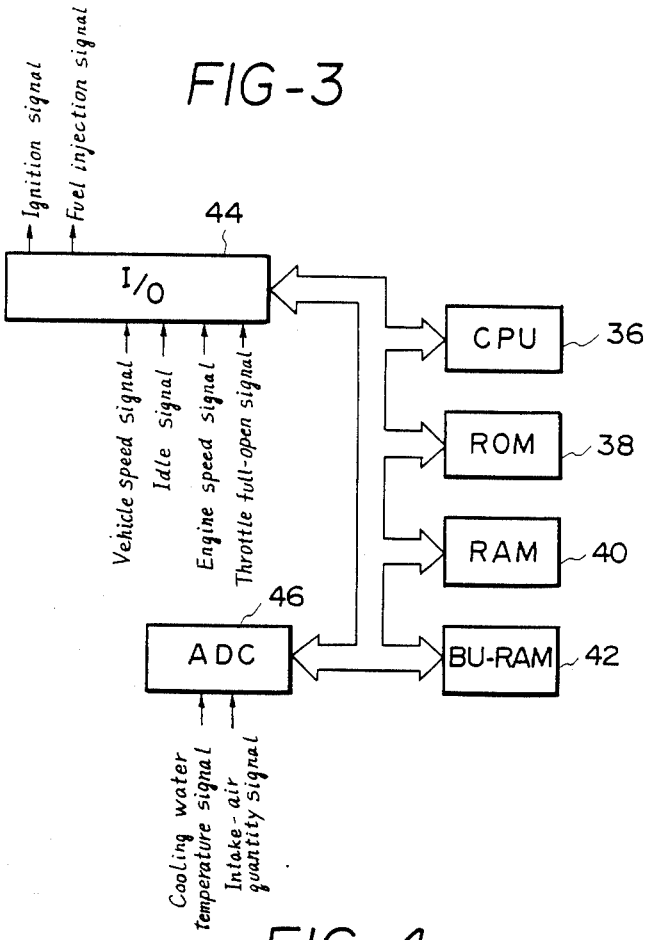
FIG. 3 is a block diagram of the control circuit shown in FIG. 2.
Figure 4:
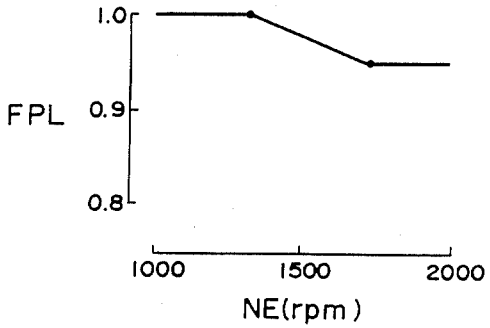
FIG. 4 is a graph showing a map of partial-lean correction coefficients employed in the embodiment of the present invention.

Referring to FIG. 3, the control circuit 30 includes a central processing unit (CPU) 36, a read-only memory (ROM) 38, a random access memory (RAM) 40, a backup RAM (BU-RAM) 42, an input/output port (I/O) 44, an analog-to-digital converter (ADC) 46, and buses for interconnecting these elements, such as a data bus and a control bus. To the I/O 44 are input an engine speed signal, an idle signal from the idle switch 6, a vehicle speed signal from the vehicle speed sensor 34, and a throttle full-open signal from the throttle full-open switch 26. From the I/O 44 are output a fuel injection signal for controlling the injection duration of the fuel injection valve 14 and an ignition signal for controlling the ON/OFF duration of the ignitor 32, these signals being delivered through a driver circuit having a down counter. The ADC 46 is supplied with, as its inputs, an intake-air quantity signal from the air flowmeter 2 and a cooling water temperature signal from the cooling water temperature sensor 20, and the ADC 46 converts these signals into digital signals, respectively. The ROM 38 has stored therein in advance a map of basic fuel injection quantity $TAU_0$ which is determined on the basis of both the rotational speed NE of the engine and the intake-air quantity Q/N per revolution of the engine and with which a particular air-fuel ratio coincides with a stoichiometric air-fuel ratio, a map of partial-lean correction coefficients determined in correspondence with various rotational speeds NE of the engine as shown in FIG. 4, and programs for routines described below.

Control routines in accordance with this embodiment will be explained below with reference to FIGS. 5 and 6. In this embodiment, the air-fuel ratio is controlled so as to coincide with a stoichiometric air-fuel ratio through an open loop control, and the air-fuel ratio is controlled in accordance with a speed reduction ratio under a predetermined operating condition of the engine.

Figure 5:
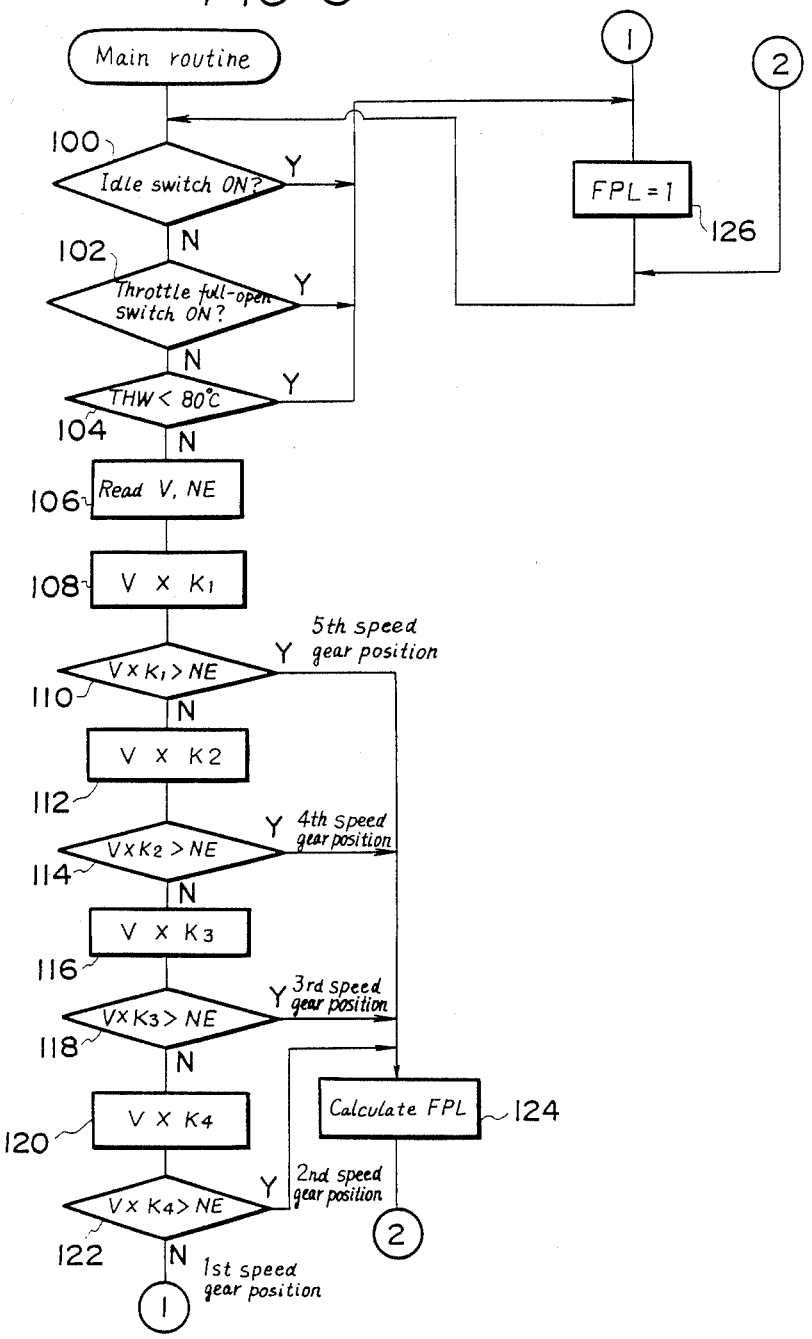
FIG. 5 is a flow chart showing a main routine in accordance with the embodiment of the present invention.

Referring to FIG. 5, which shows a main routine in accordance with this embodiment, a judgement is made as to whether or not conditions for partial-lean control are met in Steps 100 to 104. More specifically, it is judged whether or not partial-lean control conditions are satisfied by making various judgements: a judgement as to whether or not the idle switch 6 is ON; a judgement as to whether or not the throttle full-open switch 26 is ON; and a judgement as to whether or not the engine cooling water temperature THW is less than a predetermined value (e.g., 80° C.). When the answers to all the questions are NO, the partial-lean control conditions are judged to be met. When the partial-lean control conditions are not satisfied, the process proceeds to Step 126, where the partial-lean quantity FPL is set at 1 (0%).

On the other hand, when the partial-lean control conditions are met, the vehicle speed V and the engine speed NE are read in Step 106, and a speed reduction ratio, that is, the shift position of the shift lever, is detected in Steps 108 to 122. Assuming that a speed reduction ratio graph is drawn by plotting the vehicle speed V along the axis of abscissas and the engine speed NE along the axis of ordinates, NE/V measured when the shift lever is in any one of the shift positions for forward speeds is constant, and NE/V is relatively large when the shift lever is in a relatively low speed gear position, while NE/V is relatively small in a relatively high speed gear position. Accordingly, in the case of an engine equipped with a manual transmission having five shift positions, i.e., the 1st to 5th speed gear positions, it is possible to detect a speed reduction ratio, that is, a shift position, by determing a constant $K=K_1$ to $K_4$ as represented by the following formula (1), and making size comparison between VK and NE:

$$K_1<K_2<K_3<K_4 \quad (1)$$

In this embodiment, $VK_1$ to $VK_4$ are respectively obtained in Steps 108, 112, 116 and 120, and size comparisons between $VK_1$ to $VK_4$ and NE are respectively made in Steps 110, 114, 118 and 122, thereby detecting a speed reduction ratio. When a speed reduction ratio which corresponds to the 1st speed gear position is detected, the partial-lean correction coefficient FPL is set at 1 in Step 126, whereas, when a speed reduction ratio which corresponds to any one of the 2nd to 5th speed gear positions is detected, a partial-lean correction coefficient FPL which corresponds to a present engine speed NE is calculated on the basis of the map shown in FIG. 4 in Step 124.

Figure 6:
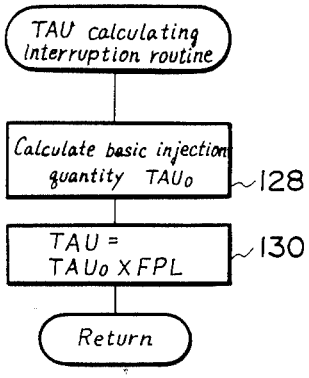
FIG. 6 is a flow chart showing an interruption routine for calculating a fuel injection quantity in accordance with the embodiment of the present invention.

FIG. 6 shows a fuel injection quantity calculating routine which is executed as an interruption routine every predetermined crank angle (e.g., every 720°). A basic fuel injection quantity $TAU_0$ is calculated by interpolation from the map stored in the ROM 38 on the basis of both the intake-air quantity Q/N per revolution of the engine and the engine speed NE in Step 128. The calculated basic fuel injection quantity $TAU_0$ is multiplied by the partial-lean correction coefficient FPL obtained as described above in Step 130 so as to decrement the basic fuel injection quantity $TAU_0$ by a rate corresponding to the partial-lean correction coefficient FPL, thereby obtaining an actual fuel injection quantity TAU, and the process then returns.

As has been described above, according to the present invention, when the partial-lean control conditions are met, the air-fuel ratio is controlled so as to be at the leaner side of the stoichiometric air-fuel ratio, and when a speed reduction ratio which corresponds to the 1st speed gear position is detected, an amount of fuel which corresponds to a basic fuel injection quantity $TAU_0$ is injected so that the air-fuel ratio coincides with the stoichiometric air-fuel ratio. Accordingly, the air-fuel ratio is controlled so as to be richer in the 1st speed gear position than those in the 2nd to 5th speed gear positions. The critical misfire air-fuel ratio becomes leaner as the engine speed increases; therefore, in this embodiment the partial-lean correction coefficient FPL for each of the 2nd to 5th speed gear positions is decreased as the engine speed increases, as shown in FIG. 4. Consequently, the air-fuel ratio is controlled so as to approach the critical misfire air-fuel ratio as the engine speed increases. Since the critical misfire air-fuel ratio becomes leaner as the engine load increases, the partial-lean correction coefficient FPL shown in FIG. 4 may be determined on the basis of the intake-air quantity Q/N per revolution of the engine.

Another embodiment of the present invention will be explained below.

Figure 7:
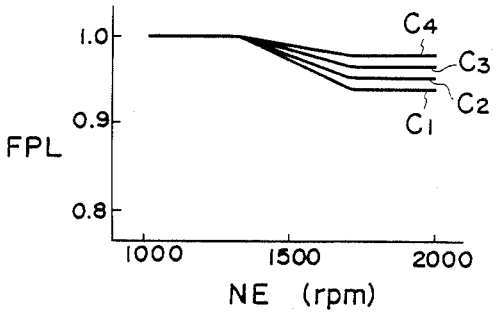
FIG. 7 is a graph showing a map of partial-lean correction coefficients employed in another embodiment of the present invention.

This embodiment is arranged such that, when a speed reduction ratio which corresponds to the 1st speed gear position is detected, the partial-lean correction coefficient FPL is set at 1 in a manner similar to that in the first embodiment so as to control the air-fuel ratio to a stoichiometric air-fuel ratio, whereas, when a speed reduction ratio which corresponds to any one of the 2nd to 5th speed gear positions is detected, a partial-lean correction coefficient FPL is calculated from the map shown in FIG. 7 to control the air-fuel ratio so as to be leaner than the stoichiometric air-fuel ratio. As the partial-lean correction coefficient FPL, the following various values may be employed in accordance with the shift lever position: a value of the curve $C_1$ in the 5th speed gear position; a value of the curve $C_2$ in the 4th speed gear position; a value of the curve $C_3$ in the 3rd speed gear position; and a value of the curve $C_4$ in the 2nd speed gear position. The values of the curves $C_1$ to $C_4$ are set so that, when the engine speed is within a range from 1000 to 1300 (rpm), the values are 1, whereas, when the engine speed is within a range from 1300 to 2000 (rpm), the values decrease as the engine speed increases, and the condition of $C_4>C_3>C_2>C_1$ is met. Accordingly, when the shift lever position is changed among the 2nd to 5th speed gear positions, the air-fuel ratio is controlled so that, as the speed reduction ratio decreases, the air-fuel ratio becomes leaner, and as the engine speed increases, the air-fuel ratio approaches the critical misfire air-fuel ratio. It should be noted that the partial-lean correction coefficient FPL shown in FIG. 7 may be determined on the basis of the intake-air quantity per revolution of the engine, or may be set at a constant value which is independent of the engine speed and the intake-air quantity per revolution of the engine (the value, however, decreasing as the speed reduction ratio decreases).

Although the present invention has been described by way of one type of engine in which a basic fuel injection quantity is determined on the basis of both the engine speed and the intake-air quantity per revolution of the engine, the present invention is not necessarily limitative thereto and may also be applid to other types of engine, for example, engines in which a basic fuel injection quantity is determined on the basis of both the intake-pipe pressure and the engine speed, engines equipped with automatic transmissions, and engines equipped with transmissions having a number of different speed gear positions which is less than 5. The partial-lean correction quantity may be obtained in terms of a rate so that the basic fuel injection quantity is decremented using this rate. Although in the above-described embodiments, the air-fuel ratio is controlled so as to coincide with a stoichiometric air-fuel ratio by an open loop control, the present invention may also be applied to one type of engine in which an $O_2$ sensor for detecting the residual oxygen concentration in exhaust gas is mounted on the exhaust manifold, and the air-fuel ratio is feedback-controlled to a stoichiometric air-fuel ratio on the basis of the output of the $O_2$ sensor. In the above-described embodiments, when the shift lever is set in the 1st speed gear position, the air-fuel ratio is controlled to a stoichiometric air-fuel ratio. However, the air-fuel ratio may be controlled so as to be leaner than the stoichiometric air-fuel ratio even in the 1st speed gear position by setting the maximum values in the maps shown in FIGS. 4 and 7 such as to be less than 1 (e.g., 0.98).

What is claimed is:

1. An apparatus for controlling an air-fuel ratio for an internal combustion engine, comprising:

calculating means for calculating a basic fuel injection quantity on the basis of an engine load and a rotational speed of said engine;

operating condition detecting means for detecting an operating condition of said engine;

speed reduction ratio detecting means for detecting a speed reduction ratio set in a transmission; and control means which controls, when a predetermined operating condition is detected, the air-fuel ratio so as to be leaner than a stoichiometric air-fuel ratio on the basis of said basic fuel unjection quantity in such a manner that the air-fuel ratio is made progressively leaner than the stoichiometric air-fuel as the speed reduction ratio becomes smaller.

2. An apparatus according to claim 1, wherein, when a predetermined operating condition is detected, said control means effects control such that the air-fuel ratio is increasingly leaner than the stoichiometric air-fuel ratio as said speed reduction ratio becomes small on the basis of said basic fuel injection quantity.

3. An apparatus according to claim 1, wherein, when a predetermined operating condition is detected, said control means controls the air-fuel ratio on the basis of said basic fuel injection quantity such that the degree by which the air-fuel ratio is made leaner than the stoichiometric air-fuel ratio is greater when said speed reduction ratio is relatively small than that in the case where said speed reduction ratio is relatively large, and the air-fuel ratio becomes increasingly leaner than the stoichiometric air-fuel ratio as the rotational speed of said engine increases.

4. An apparatus according to claim 1, wherein, when a predetermined operating condition is detected, said control means controls the air-fuel ratio on the basis of said basic fuel injection quantity such that the air-fuel ratio becomes increasingly leaner than the stoichiometric air-fuel ratio as said speed reduction ratio decreases, and the air-fuel ratio becomes increasingly leaner than the stoichiometric air-fuel ratio as the rotational speed of said engine increases.

5. An apparatus according to claim 1, wherein, when a predetermined operating condition is detected, said control means controls the air-fuel ratio on the basis of said basic fuel injection quantity such that, when said speed reduction ratio equals a value corresponding to a 1st speed gear position, the air-fuel ratio coincides with the stoichiometric air-fuel ratio, whereas, when said speed reduction ratio is smaller than the value corresponding to the 1st speed gear position, the air-fuel ratio is leaner than the stoichiometric air-fuel ratio, and as the rotational speed of said engine increases, the air-fuel ratio becomes increasingly leaner than the stoichiometric air-fuel ratio.

6. An apparatus according to claim 5, wherein, when the air-fuel ratio is smaller than the value corresponding to the 1st speed gear position, said control means effects control so that, as said speed reduction ratio decreases, the air-fuel ratio becomes increasingly leaner than the stoichiometric air-fuel ratio, and as the rotational speed of said engine increases, the air-fuel ratio becomes increasingly leaner than the stoichiometric air-fuel ratio.

7. An apparatus according to claim 1, wherein said speed reduction ratio detecting means detects a speed reduction ratio set in said transmission on the basis of the ratio between the rotational speed of said engine and the vehicle speed.

8. An apparatus according to claim 1, wherein said predetermined operating condition is a normal operating condition.

9. An apparatus for controlling an air-fuel ratio for an internal combustion engine, comprising:

load detecting means for detecting an engine load;

engine speed detecting means for detecting a rotational speed of said engine;

throttle position detecting means for detecting whether or not a throttle valve is in a region between a full-closing position and a full-open position, said region excluding these two positions;

cooling water temperature detecting means for detecting the temperature of water for cooling said engine:

vehicle speed detecting means for detecting a vehicle speed;

memory means for storing a lean correction coefficient which decreases as the rotational speed of said engine increases;

speed reduction ratio detecting means for detecting a speed reduction ratio set in a transmission on the basis of the vehicle speed and the rotational speed of said engine;

calculating means for calculating a basic fuel injection quantity on the basis of the engine load and the rotational speed of said engine; and control means which is activated when the following set of conditions is met, that is, said throttle valve is detected being in said region, the cooling water temperature is detected being higher than a predetermined value, and a speed reduction ratio is detected which is exclusive of a speed reduction ratio corresponding to a 1st speed gear position, so as to calculate a lean correction coefficient corresponding to a present engine speed on the basis of the contents stored in said memory means and control the air-fuel ratio so as to be leaner than a stoichiometric air-fuel ratio on the basis of said basic fuel injection quantity and the calculated lean correction coefficient.

10. An apparatus according to claim 9, wherein said memory means stores a plurality of lean correction coefficients respectively corresponding to speed reduction ratios exclusive of one which corresponds to the 1st speed gear position, the lean correction coefficients decreasing as the rotational speed of said engine increases, said control means being activated when said set of conditions is met, so as to calculate a lean correction coefficient corresponding to the detected speed reduction ratio and a present engine speed on the basis of the contents stored in said memory means and control the air-fuel ratio so as to be leaner than the stoichiometric air-fuel ratio on the basis of said basic fuel injection quantity and the calculated lean correction coefficient.

11. An apparatus according to claim 10, wherein said lean correction coefficients are set so as to decrease as the speed reduction ratio decreases.

12. An apparatus according to claim 9, wherein said control means controls the air-fuel ratio so as to coincide with the stoichiometric air-fuel ratio when any one of the following conditions is met: said throttle valve is in the full-closing position; said throttle valve is in the full-open position; the engine cooling water temperature is less than a predetermined value; or a speed reduction ratio corresponding to the 1st speed gear position is detected.

* * * * *

UNITED STATES PATENT AND TRADEMARK OFFICE

CERTIFICATE OF CORRECTION

PATENT NO. : 4,732,130

DATED : March 22, 1988

INVENTOR(S) : Michio SUZUKI

It is certified that error appears in the above-identified patent and that said Letters Patent is hereby corrected as shown below:

Column 7, line 36, change "unjection" to --injection--.

Column 7, line 38, change "air-fuel as" to --air-fuel ratio as--.

Signed and Sealed this

Thirteenth Day of September, 1988

*Attest:*

DONALD J. QUIGG

*Attesting Officer*

*Commissioner of Patents and Trademarks*